US005786031A

United States Patent [19]

Retallick et al.

[11] Patent Number: 5,786,031

[45] Date of Patent: Jul. 28, 1998

[54] BARRIER FOR A METAL SUBSTRATE

[75] Inventors: William B. Retallick, West Chester, Pa.; Rasto Brezny, Catonsville, Md.; Paul John Westgate, Eldersburg, Md.; James W. Patten, Jr., Baltimore, Md.; James George Miller, Ellicott City, Md.

[73] Assignee: Engelhard Corporation, Iselin, N.J.

[21] Appl. No.: 477,981

[22] Filed: Jun. 7, 1995

[51] Int. Cl.[6] ..... B05D 3/02; B05D 3/10

[52] U.S. Cl. ..... 427/376.4; 427/337; 427/380; 423/213.2; 423/213.5; 502/439

[58] Field of Search ..... 427/380, 376.4, 427/337; 502/439; 423/213.2, 213.5

[56] References Cited

U.S. PATENT DOCUMENTS

| | | |
|---|---|---|
| 2,467,114 | 4/1949 | Deyrup . |
| 3,248,251 | 4/1966 | Allen . |
| 3,446,655 | 5/1969 | Llewelyn et al. . |
| 3,770,389 | 11/1973 | Kitzner et al. . |
| 3,928,239 | 12/1975 | Yanehara et al. . |
| 4,080,276 | 3/1978 | Bode . |
| 4,199,477 | 4/1980 | Hegedus . |
| 4,592,966 | 6/1986 | Prior et al. . |
| 4,601,999 | 7/1986 | Reyallick et al. . |
| 4,639,388 | 1/1987 | Ainsworth et al. . |
| 4,673,594 | 6/1987 | Smith . |
| 4,762,567 | 8/1988 | Retallick . |
| 4,791,008 | 12/1988 | Klotz et al. . |
| 4,829,655 | 5/1989 | Cornelison et al. . |
| 4,833,025 | 5/1989 | Rossi . |
| 4,928,485 | 5/1990 | Whittenberger . |
| 4,935,073 | 6/1990 | Bartlett et al. . |
| 4,976,929 | 12/1990 | Cornelison et al. . |
| 5,070,694 | 12/1991 | Whittenberger . |
| 5,118,475 | 6/1992 | Cornelison . |
| 5,141,576 | 8/1992 | Shimamune et al. . |
| 5,141,912 | 8/1992 | Ernest et al. . |
| 5,266,860 | 11/1993 | Chiba et al. . |
| 5,288,470 | 2/1994 | Cornelison et al. . |
| 5,288,739 | 2/1994 | Demmel . |
| 5,321,231 | 6/1994 | Schmalzriedt et al. . |

FOREIGN PATENT DOCUMENTS

| | | |
|---|---|---|
| 264353 | 4/1988 | European Pat. Off. . |
| 1250906 | 9/1967 | Germany . |
| 4-203416 | 7/1992 | Japan . |
| 4-290553 | 10/1992 | Japan . |
| 4-290554 | 10/1992 | Japan . |
| 2093014 | 8/1982 | United Kingdom . |
| 2247413 | 3/1992 | United Kingdom . |

*Primary Examiner*—Shrive Beck
*Assistant Examiner*—Michael Barr
*Attorney, Agent, or Firm*—William H. Eilberg

[57] ABSTRACT

A barrier is formed on a metal substrate by coating the substrate with a metal oxide, calcining the substrate, impregnating the coated substrate with an acid, and calcining the impregnated coating at a temperature high enough to cause the metal oxide to form the barrier. The resulting barrier acts as an excellent electrical insulator, and also provides improved resistance to abrasion, and improved adhesion to the substrate. The particles forming the barrier also have improved cohesion. The metal substrate having the barrier of the present invention can be used in electrically heated catalytic converters, where it is necessary to provide closely spaced layers of metal foil that must be electrically insulated from each other. The invention can also be used in other metal structures intended to be placed in the exhaust stream of a chemical or manufacturing process or an engine.

15 Claims, 1 Drawing Sheet

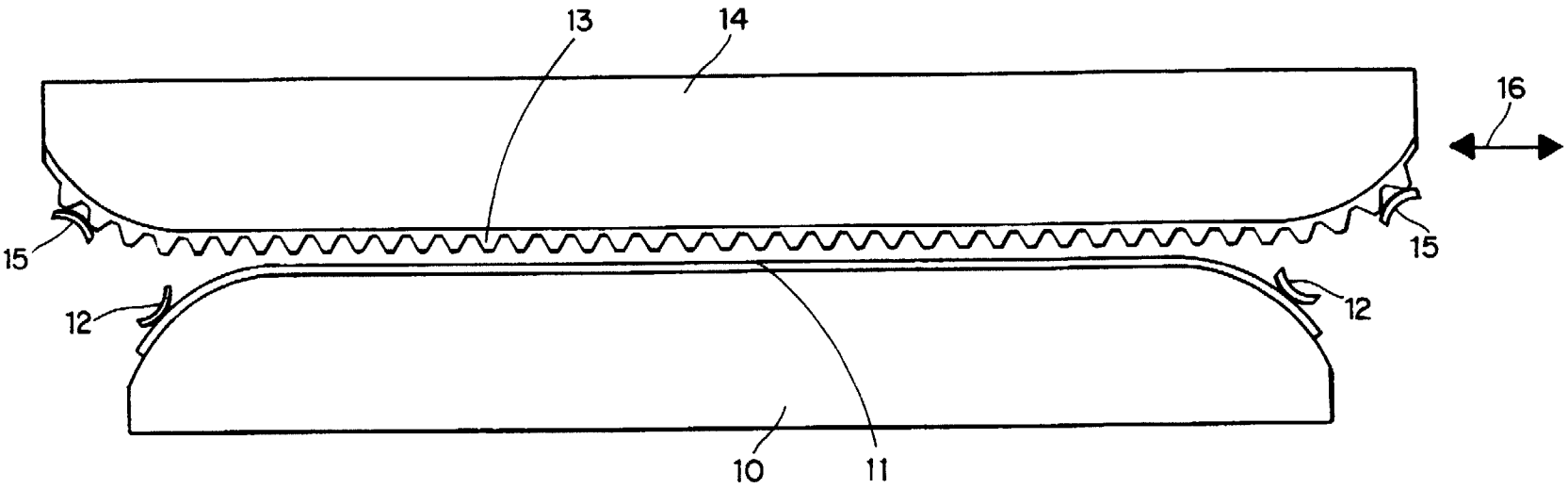
16
15
12
14
13
11
10
12
15

BARRIER FOR A METAL SUBSTRATE

BACKGROUND OF THE INVENTION

This invention provides a barrier for a metal substrate, the barrier being electrically insulating and having improved abrasion resistance, and improved adhesion to the substrate. As used in this specification, the term "barrier" means a layer that is applied to the substrate and which remains with the substrate after heat treatment. The invention is useful in electrically heated catalytic converters (EHCs), wherein it is necessary to provide metal strips which are electrically insulated from each other. However, the invention is not limited to use with EHCs, but can be used in any application requiring a tightly-adhered, durable barrier on a metal substrate.

U.S. Pat. No. 5,288,470 describes an electrically insulating barrier that can be formed on a metal strip, such that the strip can become part of an electrically operated heater, such as a heater mounted in the exhaust stream of a chemical or manufacturing process, or in the exhaust stream of a mobile or stationary engine. The disclosure of the above-cited patent is hereby incorporated by reference into this specification.

The present invention provides an improved barrier for a metal strip, such as a metal foil. The barrier of the present invention is not only an excellent electrical insulator, but also is very abrasion-resistant and durable as compared with the products available in the prior art.

SUMMARY OF THE INVENTION

The metal substrate having the barrier of the present invention can be made according to the following process. First, a metal substrate is coated with a metal oxide, such as alumina, titania, hafnia, or zirconia, and the coating is calcined at a temperature of at least about 400° C. Next, the oxide coating is impregnated with an acid. The acid can be selected from the strong acids, i.e. acids having a pKa of <0.1, including but not limited to hydrochloric acid or nitric acid, or any combination thereof, or it can be selected from the weaker acids, or combinations of weaker acids, i.e. acids having a pKa>0.1 and less than 2.5, such as phosphoric acid. Then, the impregnated coating is calcined at a temperature high enough to cause the metal oxide to form the desired barrier. The latter temperature may be about 400° C., but can vary depending on the particular coating used.

The coating of metal oxide must have a thickness sufficient to provide the desired properties, such as electrical resistance and abrasion resistance, in the barrier. Preferably, the thickness of the coating should fall within the range of about 5–40 microns, and most preferably 10–30 microns. The latter thickness is measured after the substrate and oxide coating have been calcined. In general, it may be desirable to apply the metal oxide layer in more than one coating, depending on the amount of metal oxide supplied in each coating.

The metal oxides used in the present invention include, but are not limited to, the oxides of metals such as aluminum, titanium, zirconium, or hafnium, or a mixture of oxides. The barrier formed by the present invention is more resistant to attrition than the barrier described in U.S. Pat. No. 5,288,470.

The present invention therefore has the primary object of providing a metal substrate having a barrier formed thereon.

The invention has the further object of providing a metal substrate having a barrier, wherein the barrier is an excellent electrical insulator.

The invention has the further object of providing a metal substrate having a barrier, wherein the barrier is abrasion-resistant.

The invention has the further object of providing a metal substrate having a barrier, wherein the barrier exhibits excellent adhesion to the metal.

The invention has the further object of providing a barrier on a metal surface, wherein the particles comprising the barrier exhibit improved cohesion.

The invention has the further object of enhancing the reliability and service life of an electrically heated catalytic converter (EHC), by providing an electrically-insulating barrier to coat the metal strips forming the EHC.

The invention has the further object of providing a barrier for a metal substrate, wherein the metal substrate forms part of a structure placed in the exhaust stream of an engine or of a chemical or manufacturing process.

The invention has the further object of providing a method of making the metal substrate with the barrier described above.

The reader skilled in the art will recognize other objects and advantages of the invention, from a reading of the following brief description of the drawing, the detailed description of the invention, and the appended claims.

BRIEF DESCRIPTION OF THE DRAWING

The FIGURE provides a fragmentary cross-sectional view of an apparatus used to evaluate the barrier of the present invention.

DETAILED DESCRIPTION OF THE INVENTION

The present invention is a substrate which has a barrier formed thereon. The invention also includes a method of forming the barrier on the substrate. The barrier is an excellent electrical insulator, and adheres very tightly to the substrate. The barrier is also abrasion-resistant. The particles forming the barrier also exhibit a high degree of cohesion.

The substrate and barrier can be made according to the following method. First, one coats a metal substrate with a slurry of metal oxide. The metal oxide may be an oxide of aluminum, titanium, hafnium, or zirconium. Before applying the slurry, it is preferable to pre-heat the metal substrate to form a thin layer of oxide which provides a better bond for the oxide coating. Then, one calcines the substrate and the slurry, at a temperature of at least about 400° C. The slurry is applied in an amount such that, when the substrate has been calcined, the thickness of the oxide coating is in the range of about 5–40 microns, and preferably 10–30 microns. The slurry can be applied using any of various methods known to those skilled in the art, such as painting, dipping, spraying, etc.

Next, one impregnates the coated substrate with an acid. The acid can be a weak acid, such as phosphoric acid, or a strong acid, such as an acid selected from the group consisting of nitric acid, hydrochloric acid, and sulfuric acid. One could also use any combination of weak acids or a combination of strong acids.

Finally, one calcines the impregnated structure at a temperature sufficiently high to cause the metal oxide to form the desired barrier. The entire process can be repeated after completion of the final calcining step.

When the barrier is formed, the acid partially dissolves the metal oxide coating, forming salts which decompose to produce metal oxide upon calcining. In the case of phosphoric acid, the the acid does not dissolve the metal oxide coating, but instead forms a metal phosphate after calcining.

When using a weak acid such as phosphoric acid, the acid should be applied in an amount such that the weight gain of the strip due to the acid is at least 0.25 times the weight gain due to the addition of the metal oxide.

Various devices known to those skilled in the art can be used to test the barrier formed on the metal substrate according to the present invention.

For example, the FIGURE shows an apparatus to measure the resistance to attrition. The apparatus includes a lower rail 10 of insulating plastic. A strip of metal foil 11 is coated with the barrier to be tested, and the strip is stretched along the lower rail 10. Strip 11 is held in place by clamps 12. The barrier is cleaned off the ends of strip 11 so that clamps 12 make electrical contact with strip 11.

A corrugated strip of metal foil 13 is stretched along upper rail 14 and is held in place by clamps 15. Upper rail 14 reciprocates over lower rail 10 with a one-way travel of one-half inch, as indicted by arrows 16. The total travel is 60 inches per minute. Strips 11 and 13 are in contact over a length of 6 inches. The weight of upper rail 14 is about 400 gm. The width of the upper corrugated strip is one inch, which is wider than the strip on the lower rail. The latter relationship prevents the edge of the corrugated strip from scoring the coating on the lower flat strip.

The test procedure may be to apply a voltage between strip 11, which is the strip being tested, and corrugated strip 13, and to record the time when the barrier on strip 11 fails, i.e. when current flows from one strip to the other. This procedure gives a reproducible measure of the attrition resistance of the barrier.

Alternatively, the test procedure can involve abrading strips 11, 13 for a given period of time, and thereafter measuring the weight loss from strip 11.

The following examples clarify the details of the invention, and provide information showing the degree of electrical insulation, abrasion-resistance, and adhesion exhibited by the barrier formed on the metal substrate.

EXAMPLE 1

To establish a basis for comparison of the present invention with the prior art, the attrition apparatus described above, and shown in the FIGURE, was used to test a barrier made by the method of U.S. Pat. No. 5,288,470. The test strip was of Haynes Alloy 214 with the following composition:

16% chromium
2.5 Iron
4.5 Aluminum
Balance nickel

The lateral dimensions of the strip were 0.7×8.25 inches, and the strip was 0.002 inches thick.

In this example, and in many other examples in this specification, the process steps are concisely described by a table which indicates, on the left-hand side, what was done with the strip, and, on the right-hand side, the weight of the strip (in grams) after a particular step. Thus, the left-hand column of each table describes the process applied to the strip, and shows the order of the process steps, the first step simply being providing a bare metal strip. Details on the nature of the oxide coating are given in other examples, below.

The process steps and applicable weights for this example are as follows:

| | |
|---|---|
| Bare strip | 1.4773 |
| Strip with four coats of alumina washcoat, calcined at 400° C. | 1.5878 |
| Above strip calcined at 110° C. | 1.5917 |
| Above strip with ends cleaned off for electric contact | 1.5896 |

The strip was stroked for 65 minutes. The weight loss was 0.0193, and electric contact between the strips started sometime during the 65 minutes.

The following example shows the performance of a barrier made according to the present invention.

EXAMPLE 2

This example shows the increased hardness of the barrier of this invention. The strip had the same size and composition as in Example 1.

The process steps and applicable weights were:

| | |
|---|---|
| Bare strip | 1.4784 |
| Above strip with four coats of alumina washcoat, calcined at 470° C. | 1.5893 |
| Above strip impregnated three times with phosphoric acid, and calcined at 460° C. | 1.6769 |
| Above strip calcined at 110° C. | 1.6667 |
| Above strip with its ends cleaned | 1.6575 |

The phosphoric acid (commercial 85%) was diluted to one part (by weight) $H_3PO_4$ to two parts (by weight) $H_2O$.

In this barrier, the weight gain from the phosphoric acid divided by the weight gain from the alumina was (1.6769–1.5893)/(1.5893–1.4784) or about 0.79. In this specification, the weight gain is abbreviated as $PO_4/Al_2O_3$.

This strip was stroked for one hour in the attrition machine shown in the FIGURE. Then it weighed 1.6577. The apparent weight gain is due to moisture pickup.

The stroking was continued for 4 hours while a voltage was applied between the strips. During the 4 hours, the voltage was increased in steps from 12 to 100 volts. At the end of 4 hours, when the voltage was increased to 120, the barrier failed and current flowed between the strips. Then the strip weighed 1.6575 gm.

EXAMPLE 3

The strip had the same size and composition as in Example 1.

The process steps and applicable weights were:

| | |
|---|---|
| Bare strip | 1.4676 |
| Above strip with four coats of alumina washcoats, calcined at 450° C. | 1.6095 |
| Above strip impregnated three times with one part (by weight) $H_3PO_4$ to one part (by weight) $H_2O$, and calcined at 450° C. | 1.6702 |
| Above strip calcined at 110° C. | 1.6723 |
| Above strip with ends cleaned | 1.6672 |

The weight gain $PO_4/Al_2O_3$ was 0.43.

This strip was stroked for 6.8 hours while the voltage was increased in steps to 120. Then the strip was turned over and tested on the other side for 10 hours while the voltage was increased in steps to 120. Then the strip was heated to 165° C. to expel absorbed moisture. Then the strip weighed 1.6663 gm, for a loss of about 0.001 gram in 16 hours. The barrier remained intact during these 16 hours.

EXAMPLE 4

The strip in this example had the same size and composition as in Example 1.

The process steps and applicable weights were:

| | |
|---|---|
| Bare strip | 1.4674 |
| Above strip with two coats of alumina washcoat calcined at 400° C. | 1.5195 |
| Above strip impregnated three times with one part $H_3PO_4$ to one part $H_2O$, and calcined at 450° C. | 1.5431 |
| Above strip calcined at 110° C. | 1.5480 |
| Above strip with ends cleaned off | 1.5468 |

The weight gain $PO_4/Al_2O_3$ was 0.45.

With this light coating of alumina, the barrier was ineffective, and barely withstood 12 volts. After about 30 minutes of stroking, the strip weighed 1.5470 gm, so there was no measurable loss in weight, even though the barrier was ineffective.

EXAMPLE 5

The strip had the same size and composition as in Example 1.

The process steps and applicable weights were:

| | |
|---|---|
| Bare strip | 1.4701 |
| Above strip with four coatings of alumina washcoat, calcined at 420° C. | 1.6000 |
| Above strip impregnated three times with one part $H_3PO_4$ to one part $H_2O$, and dried at 168° C. | 1.6527 |
| Above strip calcined at 1100° C. | 1.6534 |
| Above strip with ends cleaned | 1.6485 |

The weight gain $PO_4/Al_2O_3$ was 0.41.

The strip was stroked for 4 hours while the voltage was increased in steps to 120. The barrier remained intact. The strip weighed 1.6488, with no loss. The strip was turned over and tested on the other side. The barrier failed after about 40 minutes, when the voltage was 80. Then the strip weighed 1.6484 gm, still no loss. An ohmmeter probe was run along the edges of the strip, and showed that the barrier had failed on the edge, as usual. In this example the strip was dried at the low temperature of 168° C. after each impregnation with phosphoric acid. Apparently calcining at high temperature is not necessary until after the final impregnation.

EXAMPLE 6

The strip had the same size and composition as in Example 1.

The process steps and applicable weights were:

| | |
|---|---|
| Bare strip | 1.4718 |
| Above strip with four coatings of alumina washcoat, and calcined at 450° C. | 1.5655 |
| Above strip impregnated once with one part $H_3PO_4$ to one part $H_2O$ and calcined at 500° C. | 1.5841 |
| Above strip calcined at 1110° C. | 1.5869 |
| Above strip with ends cleaned | 1.5860 |

The weight gain $PO_4/Al_2O_3$ was 0.20.

This strip was stroked for one hour. After stroking, it weighed 1.5827, for a loss of 0.0033 gm. This low level of $PO_4/Al_2O_3$ produces some hardening, but no electrically insulating barrier. There was electrical contact between the strips from the start of the test.

EXAMPLE 7

The strip had the same size and composition as in Example 1.

The process steps and applicable weights were:

| | |
|---|---|
| Bare strip | 1.4590 |
| Above strip with six coats of alumina washcoat, and calcined at 300° C. | 1.6455 |
| Above strip impregnated three times with one part $H_3PO_4$ to one part $H_2O$, and dried at 165° C. | 1.7179 |
| Above strip calcined at 900° C. | 1.7123 |
| Above strip with the ends cleaned | 1.7005 |

The weight gain $PO_4/Al_2O_3$ was 0.39.

The strip was stroked for 4.7 hours while the voltage was increased in steps to 120. The barrier remained intact. Then the strip weighed 1.7017, with no measurable loss. The strip was turned over and tested on the other side. The barrier failed after about 1.5 hours, at 80 volts. The strip weighed 1.7021 gm, again with no measurable loss. This test indicates that the final calcining temperature can be lowered to 900° C.

EXAMPLE 8

This example describes the preparation of the alumina washcoat used in the foregoing examples. A five liter ball mill is charged with 4600 gm of Burundum™ grinding medium and:

384 gm Catapal G 36.4 gm Disperal 34.4 gm concentrated nitric acid 567 gm water

The mill was turned for 4 hours, and the product washcoat was poured out. About 1000 gm of washcoat was produced in each batch. Catapal G is a calcined gamma alumina supplied by Vista Chemical Co. Disperal is an uncalcined dispersible alumina supplied by Condea Chemie of Germany.

EXAMPLE 9

Here we describe the preparation of the alumina washcoat used in Example 10. Catapal B is an uncalcined nondispersible alumina. This material was calcined at 600° C. to produce an alumina equivalent to the Catapal G used in Example 8. A 1.1 liter ball mill was charged with 1600 gm zirconia grinding medium and:

100.0 gm calcined Catapal B 10.0 gm Disperal 10.0 gm concentrated nitric acid 170 gm water.

The mill was turned for 4 hours and 255 gm of washcoat was poured out.

EXAMPLE 10

The strip had the same size and composition as in Example 1.

The process steps and applicable weights were:

| | |
|---|---|
| Bare strip | 1.5634 |
| Above strip with six coats of alumina washcoat, and calcined at 300° C. | 1.7688 |
| Above strip impregnated once with three parts $H_3PO_4$ to one part $H_2O$, and calcined at 300° C. | 1.8235 |
| Above strip calcined at 600° C. | 1.8198 |
| Above strip with ends cleaned | 1.8088 |

The weight gain $PO_4/Al_2O_3$ was 0.27.

The barrier failed in the first two minutes of stroking, and the electrical contact was located on the edge of the strip. The one-inch wide upper corrugated strip was replaced with a flat strip ¼-inch wide. The contact on the edge of the test strip was bypassed thereby. Stroking was resumed and continued for 10.7 hours while the voltage was increased in steps to 140. The barrier remained intact. Then the strip weighed 1.8064 gm, with an apparent loss of 0.0024. This test indicates that the final calcining temperature can be reduced to 600° C.

EXAMPLE 11

This example describes the preparation of the titania washcoat used in Example 12.

The preparation begins with a solution of titanyl sulfate, $TiOSO_4$ that assays 9.4 wt % $TiO_2$. Fifty grams of $TiOSO_4$ solution was diluted to about 540 gm, and the pH was increased to 2.8 with ammnonium hydroxide. This precipitates most, but not all, of the $TiO_2$ as a hydrous oxide. Then 0.80 gm of phosphoric acid was added. This reduced the pH to 2.5, and also precipitated the last of the titania. The precipitate was collected on a filter and washed free of sulfate ion. The filter cake weighed 57 gm. The cake was dried under vacuum to a weight of 30 gm. The dried cake was charged to a ball mill along with 3.6 gm of concentrated nitric acid. The mill was turned until the cake was reduced to water thin consistency. Then 18 gm of Kemira titania 907 was added to the mill, and the mill was turned until the washcoat reached a constant thin consistency.

EXAMPLE 12

The strip had the same size and composition as in Example 1.

The process steps and applicable weights were:

| | |
|---|---|
| Bare strip | 1.4780 |
| Above strip with four coats of titania washcoat, and calcined at 400° C. | 1.6036 |
| Above strip impregnated with undiluted $H_3PO_4$, (85% concentration) and calcined at 400° C. | 1.6482 |
| Above strip calcined at 900° C. | 1.6454 |

The weight gain $PO_4/TiO_2$ was 0.35.

Before starting a test on the attrition apparatus, an ohmmeter probe was run along both edges of the strip. There was electrical contact all along both edges. To make a meaningful test, the upper one-inch corrugated strip was replaced with a ¼-inch flat strip, just as was done in Example 10. The stroking test lasted for 3.6 hours while the voltage was increased to 80. Then the voltage was increased to 100 and the barrier failed in less than one-half hour. The strip was turned over and tested on the other side. The test (on the other side) lasted for 3 hours while the voltage was increased in steps to 100. The barrier failed at 3 hours when the voltage was 100.

EXAMPLE 13

This example describes a barrier of hafnium oxide. The source of the hafnium was the oxychloride $HfOCl_2.8\ H_2O$, formula weight 409, supplied by Teledyne Wah Chang.

One tenth mol, 40.9 gm, of oxychloride was dissolved into 900 gm of solution. The pH was raised to 7.0 with ammnonium hydroxide which precipitated a hydrous oxide. The precipitate was collected on a filter and washed free of chloride ions. The undried filter cake weighed 220 gm. The cake was dried under vacuum to a weight of 24.9 gm. The cake was charged to a ball mill along with 3.7 gm of concentrated nitric acid and 21 gm water. The mill was turned for 1.6 hours. Forty gm of milk white water thin washcoat was poured out of the mill.

The test strip was of Allegheny Ludlum's alloy Alfa IV with the following composition:

20% chromium

5% aluminum balance mostly iron

The size of the strip was 3.5×6 inches and 0.002 inch thick. Strips of this size were used early in this work, before the test apparatus described above, and shown in the FIGURE, had been built. Therefore, the effectiveness of the barrier was measured by dragging the two probes of the ohmmeter across the surface of the strip. If there was infinite resistance between the probes, the barrier was intact.

The process steps and applicable weights were:

| | |
|---|---|
| Bare strip | 4.7056 |
| Above strip with first coat of hafnia washcoat, on one side, dried at 185° C. | 4.7409 |
| Above strip impregnated with one part $H_3PO_4$ to three parts $H_2O$, and dried at 185° C. | 4.7508 |
| Above strip calcined at 850° C. | 4.7457 |
| Above strip with second coating of hafnia washcoat, dried at 185° C. | 4.7759 |
| Above strip impregnated with one part $H_3PO_4$ to three parts $H_2O$, and dried at 185° C. | 4.7874 |
| Above strip calcined at 850° C. | 4.7816 |

The weight gain $PO_4/HfO_2$ was 0.16.

After the second coating, but not after the first coating, there was infinite resistance between the ohmmeter probes.

EXAMPLE 14

This example describes a barrier of zirconium oxide. The source of the zirconium was the oxynitrate $ZrO(NO_3)_2$ supplied by Pfaltz and Bauer as a water solution.

Experiments had shown that 100 gm of this solution requires 0.65 equivalents of alkali to give complete precipitation. This amount of anmonium hydroxide was diluted into 2 liters of solution and 100 gm of oxynitrate solution was added with stirring. The precipitate was collected on a filter and washed. The filter cake was dried in an oven at 90° C. to a final weight of 23.6 gm. A second 100 gm of oxynitrate solution was precipitated in the same way. The washed undried filter cake weighed 190 gm. This undried cake plus the 23.6 gm of dried cake, plus 4 gm of concentrated nitric acid and 4 gm of water, was charged to a ball mill. The mill was turned for 4 hours and then 203 gm of washcoat was poured out.

The metal strip had the same size and composition as in Example 13. The process steps and applicable weights were:

| | |
|---|---|
| Bare strip | 4.6713 |
| Above strip with first coat of zirconia washcoat, dried at 175° C. | 4.6846 |
| Above strip impregnated with one part $H_3PO_4$ to five parts $H_2O$, and dried at 185° C. | 4.6902 |
| Above strip calcined at 470° C. | 4.6889 |
| Above strip with second coat of zirconia washcoat, dried at 190° C. | 4.7057 |
| Above strip calcined at 500° C. | 4.7030 |
| Above strip impregnated with one part $H_3PO_4$ and five parts $H_2O$, and dried at 180° C. | 4.7131 |
| Above strip calcined at 530° C. | 4.7108 |
| Above strip with third coat of zirconia washcoat, dried at 180° C. | 4.7344 |
| Above strip calcined at 550° C. | 4.7304 |
| Above strip impregnated with one part $H_3PO_4$ and five parts $H_2O$, and dried at 185° C. | 4.7418 |
| Above strip calcined at 570° C. | 4.7386 |
| Above strip calcined at 850° C. | 4.7376 |

The weight gain $PO_4/ZrO_2$ was 0.38.

After the third coating with zirconia, but not after the second coat, there was infinite resistance between the ohmmeter probes.

EXAMPLE 15

This Example describes a barrier that contains the oxides of both titanium and zirconium. A feature of this titania-zirconia washcoat is that it is made in a single step, unlike the titania washcoat of Example 11 or the zirconia of Example 14. The washcoat of this Example was made by ball milling together a solution of zirconyl nitrate, $ZrO(NO_3)_2$, and titanium oxide. In a typical preparation, the ball mill was charged with:

105.2 gm Kemira 907 titanium oxide 82.5 gm $ZrO(NO_3)_2$ solution 72 gm water

The mill was turned for one hour. The $ZrO(NO_3)_2$ solution contains 20.6% $ZrO_2$, and Kemira 907 contains 81.7% $TiO_2$ so that the mol ratio ($Zro_2/TiO_2$) was 0.13.

A strip of Alfa IV, having dimensions of 3.5×6 inches, was coated with the above-described material. The process steps and applicable weights were:

| | |
|---|---|
| Weight of bare strip | 4.6417 |
| Above strip with four coats of washcoat on just one side, calcined at 500° C. | 5.0418 |
| Above strip impregnated with one weight $H_3PO_4$ to 0.5 weights $H_2O$, dried, and calcined at 500° C. | 5.1194 |
| Above strip again impregnated, dried and calcined at 500° C. | 5.1920 |

The weight gain $PO_4/(ZrO_2+TiO_2)$ was 0.38.

A narrow strip ¼ inch wide was cut off the 6-inch side of the coated Alfa IV. The ¼-inch strip was folded upon itself with the coated side on the outside of the fold, and the fold was pressed flat. Only a little of the barrier peeled off along the fold line, indicating good adherence of this barrier.

Further experiments showed that good adherence is obtained over a mol ratio of $ZrO_2/TiO_2$ from about 0.11 to 0.15.

EXAMPLE 16

This Example provides a frame of reference for testing the effects of different acid treatments in making the coated substrate of the present invention. In this and in all of the following Examples, the metal substrate was made of Haynes 214 nickel-based alloy having a thickness of 50 microns (about 0.002 inches). The metal substrate was pre-treated to form a thin oxide film by heating in air to 550° C. for one minute, so as to provide a hydrophilic surface for the alumina washcoat. To the preoxidized foil there was applied, by electrophoretic deposition, a layer of alumina washcoat, of the type described in Example 8, above. The washcoat was dried using a heat gun to form a porous alumina coating containing some hydrated alumina species. The coated foil was calcined at 950° C. for 15 minutes in air to convert all hydrated alumina species to the oxide and to form chemical bonds between the coating and the foil (i.e. to provide adhesion) as well as between the alumina particles themselves (i.e. to provide cohesion). The thickness of the coating after calcination was 25 microns.

The adhesion energy was measured using a Hesiometer blade adhesion tester, which is commercially available from Adhesion International, Inc., of Spokane, Washington. This instrument measures the adhesion of the barrier. The results may differ from those obtained with the abrasion instrument shown in the FIGURE. The results obtained with the latter instrument more closely correlate with cohesion, i.e. the bonding among the particles of alumina.

The adhesion energy was measured using the Hesiometer blade adhesion tester, which used a 5-mm wide blade set at an angle of 30° relative to the foil and a normal force of 10N to scrape the coating from the metal foil. The energy required to remove the coating is equal to the practical adhesion energy. For this Example which involved a substrate having a metal oxide coating, unmodified by acid, the adhesion energy was 199 $J/m^2$.

EXAMPLE 17

This Example and the following Examples involve the use of nitric, hydrochloric, and phosphoric acids to harden the alumina coating applied to metal foils. The concentrations used were based on a 3:1 dilution of concentrated acid and water. However, in general, a normality sufficient to cause dissolution of alumina is sufficient. This would include concentrations greater than 1 Normal up to concentrated acid. The more dilute the acid, the more applications of acid will be required to achieve the desired level of adhesion.

In this Example, and in the subsequent Examples, the pre-treatment of the foil and application of the base alumina coating were identical to Example 16.

Following the calcination at 950° C. for 15 minutes, the coating was treated in the following way, to modify the coating and to improve the adhesion energy. The coating was impregnated with 8N HCl acid by brushing to saturation. The impregnated coating and foil were then air dried using an air gun followed by a second calcination at 950° C. for 15 min. A second impregnation with 8N HCl acid, followed by drying and calcination steps, were performed to achieve the additional bonding necessary for improved adhesion. The adhesion energy was measured as above, and a significant improvement due to the acid treatment was observed. The adhesion energy was 460 $J/m^2$ (at 10N force, with a blade angle of 30°).

EXAMPLE 18

Following the calcination to 950° C. for 15 minutes, the coating was treated in the following way to modify the coating and improve the adhesion energy. The coating was impregnated with 10N $HNO_3$ acid by brushing to saturation. The impregnated coating and foil was then air dried using an air gun followed by a second calcination at 950° C. for 15 minutes. A second impregnation with 10N $HNO_3$ acid, followed by drying and calcination steps, were performed. The measured adhesion energy was 390 $J/m^2$ (at 10N force, with a blade angle of 30°).

EXAMPLE 19

Following the calcination to 950° C. for 15 minutes, the coating was treated in the following way to modify the coating and improve the adhesion energy. The coating was impregnated with 5.5N $H_3PO_4$ acid by brushing to saturation. The impregnated coating and foil were then air dried using an air gun followed by a second calcination at 950° C. for 15 minutes. A second impregnation with 5.5N $H_3PO_4$ acid, followed by drying calcination steps, were performed. The measured adhesion energy was 418 $J/m^2$ (at 10N force, with a blade angle of 30°).

Examples 17–19 show that the addition of acid to the oxide coating substantially increases the adhesion energy of the barrier formed according to the present invention. In the case of the strong acids, the alumina was partially dissolved and re-deposited upon calcining. The acid (phosphoric acid in the Examples) did not dissolve the alumina, left a residue of aluminum phosphate.

The invention can be modified further, such as by increasing the number of oxide coatings, increasing the amount of acid used, and/or increasing the calcining temperatures. These and other similar modifications should be considered within the spirit and scope of the following claims.

What is claimed is:

1. A method of making an electrically insulating barrier on a metal substrate, the method comprising the steps of:

a) coating a metal substrate with a finely pulverized washcoat of metal oxide, b) calcining the washcoat to leave a coating of metal oxide, c) impregnating the coating formed in step (b) with phosphoric acid, and d) calcining the impregnated coating of step (c) at a temperature sufficient to cause the phosphoric acid to react with the metal oxide to form an electrically insulating barrier.

2. The method of claim 1, wherein the washcoat is applied in an amount sufficient to create a coating having a thickness, after completion of step (d), in a range of about 5–40 microns.

3. The method of claim 2, wherein the thickness of the coating is in the range of 10–30 microns.

4. The method of claim 1, wherein the metal oxide is selected from the group consisting of alumina, titania, hafnia, and zirconia.

5. The method of claim 1, wherein the phosphoric acid used in the impregnating step has a concentration of about 85%, diluted to one part (by weight) acid to two parts (by weight) water.

6. The method of claim 1, wherein steps (a), (b), (c) and (d) are repeated in order after an initial completion of step (d).

7. A method of making an electrically insulating barrier on a metal substrate, the method comprising the steps of:

a) coating a metal substrate with a finely pulverized washcoat of metal oxide, b) calcining the washcoat to leave a coating of metal oxide, c) impregnating the coating formed in step (b) with nitric acid, and d) calcining the impregnated coating of step (c) at a temperature sufficient to cause the nitric acid to react with the metal oxide to form an electrically insulating barrier.

8. The method of claim 7, wherein the metal oxide is selected from the group consisting of alumina, titania, hafnia, and zirconia.

9. The method of claim 7, wherein steps (a), (b), (c) and (d) are repeated in order after an initial completion of step (d).

10. A method of making an electrically insulating barrier on a metal substrate, the method comprising the steps of:

a) coating a metal substrate with a finely pulverized washcoat of metal oxide, b) calcining the washcoat to leave a coating of metal oxide, c) impregnating the coating formed in step (b) with hydrochloric acid, and d) calcining the impregnated coating of step (c) at a temperature sufficient to cause the hydrochloric acid to react with the metal oxide to form an electrically insulating barrier.

11. The method of claim 10, wherein the metal oxide is selected from the group consisting of alumina, titania, hafnia, and zirconia.

12. The method of claim 10, wherein steps (a), (b), (c) and (d) are repeated in order after an initial completion of step (d).

13. A method of making an electrically insulating barrier on a metal substrate, the method comprising the steps of:

a) coating a metal substrate with a finely pulverized washcoat of metal oxide, b) calcining the washcoat to leave a coating of metal oxide, c) impregnating the coating formed in step (b) with an acid comprising a combination of nitric acid and hydrochloric acid, and d) calcining the impregnated coating of step (c) at a temperature sufficient to cause the acid to react with the metal oxide to form an electrically insulating barrier.

14. The method of claim 13, wherein the metal oxide is selected from the group consisting of alumina, titania, hafnia, and zirconia.

15. The method of claim 13, wherein steps (a), (b), (c) and (d) are repeated in order after an initial completion of step (d).

* * * * *